US007467806B1

(12) United States Patent
Goode et al.

(10) Patent No.: US 7,467,806 B1
(45) Date of Patent: Dec. 23, 2008

(54) LIGHTWEIGHT SKI STABILITY SYSTEM

(75) Inventors: David Goode, Vail, CO (US); Iain Hueton, Ogden, UT (US)

(73) Assignee: D2 Investments, LLC, Ogden, UT (US)

( * ) Notice: Subject to any disclaimer, the term of this patent is extended or adjusted under 35 U.S.C. 154(b) by 0 days.

(21) Appl. No.: 11/780,406

(22) Filed: Jul. 19, 2007

(51) Int. Cl.
*A63C 5/06* (2006.01)

(52) U.S. Cl. ..... 280/601; 280/610; 280/809

(58) Field of Classification Search ..... 280/813, 280/809, 601, 610, 11.14, 11.17, 611
See application file for complete search history.

(56) References Cited

U.S. PATENT DOCUMENTS 4,154,457 A * 5/1979 Auer et al. ..... 280/601
4,199,169 A 4/1980 Guenzel et al.
4,674,763 A * 6/1987 Schlagenhaufer ..... 280/602
4,895,388 A * 1/1990 Richmond ..... 280/609
5,143,394 A * 9/1992 Piana ..... 280/602
5,203,583 A * 4/1993 LeGrand et al. ..... 280/602
5,820,154 A 10/1998 Howe
5,915,716 A * 6/1999 Artus ..... 280/602
6,102,425 A 8/2000 Gotzfried

* cited by examiner

*Primary Examiner*—Christopher P Ellis
*Assistant Examiner*—John D Walters
(74) *Attorney, Agent, or Firm*—Trent H. Baker; Baker & Associates PLLC

(57) ABSTRACT

The present invention relates to lightweight ski systems. One embodiment of the present invention relates to a lightweight ski stability system for improving performance while maintaining lightweight characteristics. The ski stability system includes a ski and one or more weighted members. One weighted member is positioned on the upper surface of the ski within 10 centimeters of the tip contact point. A second optional weighted member is positioned on the upper surface of the ski within 10 centimeters of the tail contact point. The contact points refer to a lengthwise position before the tip or tail laterally curve upward. The weighted members weigh at least 3% of the ski weight. The disposition of these weighted members at one or both of the contact points increases the rotational inertia characteristics of the lightweight ski while minimizing the resulting weight. A second embodiment of the present invention relates to a method of increasing the rotational inertia of a lightweight ski.

20 Claims, 2 Drawing Sheets

LIGHTWEIGHT SKI STABILITY SYSTEM

FIELD OF THE INVENTION

The invention generally relates to lightweight ski systems. In particular, the present invention relates to a lightweight ski stability system.

BACKGROUND OF THE INVENTION

Skiing is the act of a user gliding over a snow-covered surface with extended skis attached to each foot. Necessary equipment for skiing includes boots, bindings, and skis. A user's performance is directly related to their physical abilities and the characteristics of their equipment. Various improvements in equipment performance therefore enable a skier to improve their skiing performance without necessarily improving their physical abilities. However, technical improvements must be balanced with the potential negative effects caused by the improvements, so as not to increase one characteristic while significantly decreasing a different characteristic thereby negating the improvements in overall performance.

One of the common problems with conventional skis is weight. Traditional skis are composed of wood and/or fiberglass to take advantage of flexibility properties. During a ski turn or transition, a ski may flex or bend to enable redirection in the snow. Originally, weight was not considered an important performance characteristic; thus, skis were very long and made of heavy wood materials. Various types of skiing benefit greatly from lighter weight skis including ski transportation, backcountry skiing (off-piste), telemark, alpine touring, etc. A shift was made to shorter fiberglass skis to minimize weight among other performance factors. However, fiberglass skis require an inherent minimum weight to maintain acceptable performance. Therefore, the evolution of even lighter weight skis such as carbon-fiber skis represents an advancement in the ability to further reduce ski weight while maintaining performance.

While the overall weight of a carbon-fiber ski is lower than conventional wood and fiberglass skis, the rotational flex, torsion, and stability characteristics of carbon-fiber skis are different. These differences may be advantageous or limiting, depending on a skier's ability and preferences. Some skiers may notice more difficulty executing a turn and/or holding an edge at certain speeds and under certain skiing conditions using a lightweight carbon-fiber ski. This difficulty is attributable to the natural rotational inertia properties of carbon-fiber. While carbon has an inherently high torsional rigidity, the lengthwise rotational rigidity is relatively lower than other commonly used ski materials. Likewise, other lightweight ski materials may also exhibit similar flexibility affects thereby partially negating their improvements in overall weight.

Therefore, there is a need in the industry for a system that improves the high-speed stability performance of a lightweight ski without dramatically increasing the overall weight. The system should be applicable to any lightweight skiing system including carbon-fiber skis.

SUMMARY OF THE INVENTION

The present invention relates to lightweight ski systems. One embodiment of the present invention relates to a lightweight ski stability system for improving performance while maintaining lightweight characteristics. The ski stability system includes a ski and one or more weighted members. One weighted member is positioned on the upper surface of the ski within 10 centimeters of the tip contact point. A second optional weighted member is positioned on the upper surface of the ski within 10 centimeters of the tail contact point. The contact points refer to a lengthwise position before the tip or tail laterally curve upward. The weighted members weigh at least 3% of the ski weight. The disposition of these weighted members at one or both of the contact points increases the rotational inertia characteristics of the lightweight ski while minimizing the resulting weight. A second embodiment of the present invention relates to a method of increasing the rotational inertia of a lightweight ski.

Conventional skis are composed of relatively heavy weighted materials including fiberglass and wood. While these materials exhibit certain preferred characteristics, they have a relatively high minimum weight necessary for optimal performance. Advanced lightweight skis composed of materials such as carbon-fiber are significantly lighter while maintaining many of the performance characteristics of conventional skis. However, the lighter weight inherently reduces to rotational inertia of the ski. The present invention relates to a system that increases the rotational inertia of a lightweight ski while minimizing the overall weight. Therefore, a lightweight ski will perform in a manner consistent with a heavy ski while maintaining the lightweight performance advantages.

In the 1970s, a company called Fritzmeir created a ski that included a weighting system. These skis were composed of heavy materials such as wood but were shorter than other conventional skis of the era. Naturally, shorter skis exhibit different performance characteristics. The purpose of the weighting system was to create long ski performance from a relatively short ski. Unfortunately, the Fritzmeir weighting system failed in the market due to the fact that it resulted in making an extremely heavy ski with poor performance. Embodiments of the present invention are a significant improvement over the Fritzmeir system in that they utilize a position specific weighting system in a unique way to improve the performance of a lightweight ski disproportionately to the amount of weight added to the ski; As opposed to the Fritzmeir system which attempted to mimic the performance of a long ski with a short ski but only resulted in creating a very heavy short ski.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1:
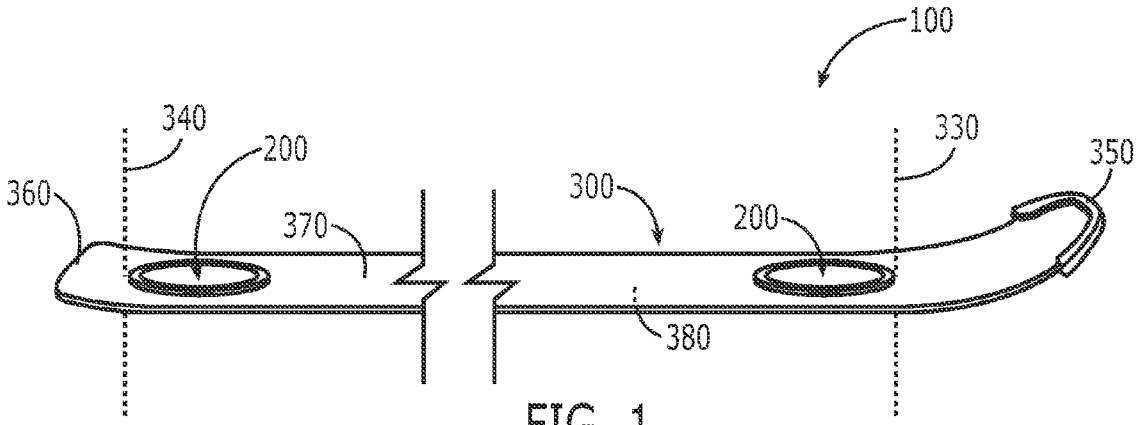
FIG. 1 illustrates a perspective view of a lightweight ski stability system in accordance with one embodiment of the present invention.

The present invention relates to lightweight ski systems. One embodiment of the present invention relates to a lightweight ski stability system for improving performance while maintaining lightweight characteristics. The ski stability system includes a ski and one or more weighted members. One weighted member is positioned on the upper surface of the ski within 10 centimeters of the tip contact point. A second optional weighted member is positioned on the upper surface of the ski within 10 centimeters of the tail contact point. The contact points refer to a lengthwise position before the tip or tail laterally curve upward. The weighted members weigh at least 3% of the ski weight. The disposition of these weighted members at one or both of the contact points increases the rotational inertia characteristics of the lightweight ski while minimizing the resulting weight. A second embodiment of the present invention relates to a method of increasing the rotational inertia of a lightweight ski. Also, while embodiments are described in reference to a lightweight ski stability system, it will be appreciated that the teachings of the present invention are application to other areas.

The following terms are defined as follows:

Ski—an elongated platform to facilitate travel over a snow-covered surface. Skis may be created for various applications including but not limited to cross country skis, alpine skis, touring skis, racing ski, etc. Each type of ski may include unique characteristics so as to maximize performance at a particular application.

Rotational inertia of a ski—a measurement of the ski's resistance to bend or rotate lengthwise about the boot-ski attachment point. A lengthwise rotation may be characterized as resistance to the tip or tail region of the ski bending laterally to the side with respect to the boot-ski attachment point. The term "rotational inertia" may also be expressed as "stability control" or "lateral stability".

Torsion of a ski—a measurement of the ski's resistance to bend or rotate widthwise about the boot-ski attachment point. A widthwise rotation may be characterized as the tip or tail regions rotating about the lengthwise axis with respect to the boot-ski attachment point.

Boot-ski attachment—the location on a ski of the connection point/region between a user's boot and the ski. The exact location of a boot-ski attachment point may be further determined based on the type of ski binding. For example, some ski bindings may direct the boot-ski attachment point to a specific location corresponding to the sole of a user's boot while other ski bindings may create two specific boot-attachment points at the front and rear connection points between the binding and ski.

Contact point—a lengthwise ski location away from the median corresponding to the furthest location in either the front or rear direction before the lower surface of the ski curves upward. For example, a tip contact point is located at the front of the ski before the tip region of the lower surface curves upward.

Weighted member—a weighting element configured to disposed a particular amount of weight at a particular location for purposes of affecting skiing performance.

Reference is initially made to FIG. 1, which illustrates a lightweight ski stability system in accordance with one embodiment of the present invention, designated generally at 100. The illustrated system 100 includes a ski 300 and two weighted members 200. The ski 300 further includes an upper surface 370, a lower surface 380, a tip 350, a tail 360, a tip contact point 330, and a tail contact point 340. The ski 300 is an elongated structure that extends lengthwise between the tip 350 and tail 360. The lateral and thickness dimensions of the ski 300 are substantially smaller than the lengthwise dimension. The frontal region of the ski curves upward slightly from a lateral perspective to form the tip 350. The tip contact point 330 is located at the furthest frontal lengthwise ski location before the lower surface curves upward. Likewise, the tail contact point 340 is located at the furthest rear lengthwise ski location before the lower surface curves upward. It will be appreciated that various skis have different tip and tail contact points. The weighted members 200 are disposed on the upper surface 370 of the ski within the vicinity of the contact points. Although not illustrated, a binding may be coupled to the upper surface 370 of the ski to create a boot-ski attachment point.

In operation, the described positioning of a weight at the tip and tail contact points 340, 330 maximizes the spacing between the boot-ski attachment region of the ski and added weight. It has been determined that the lateral stability (rotational inertia) of a particular lengthwise location on the ski is mathematically related to the square of the distance between the boot-ski attachment and the particular lengthwise location. This calculation may also be normalized across the entire front and rear regions of the ski to account for the weight of the ski itself. Conventional skis essentially evenly distribute weight across the ski due to the inherent weight of the ski materials. Weight positioned in close proximity to the boot-ski attachment therefore has an inefficient affect on lateral stability. Positioning the additional weight at a maximal distance away from the boot-ski attachment dramatically increases lateral stability while minimizing the necessary weight increase.

The following ski stability data has been measured to make an accurate comparison of the affects of the described ski weighting system in relation to a conventional ski.

$$\text{Rotational inertia(RI)}=\text{Weight(W)}\times\text{Distance(D)}^2$$

Weight=weight at the specific location measured

Distance=the distance to the location measured (may also be considered a radius about which the rotation occurs)

Rotational inertia of a ski must account for the weight across the entire length of the ski and therefore must normalized for the different distances. Whereas, the rotational inertia caused by the additional weights may be calculated directly for the particular location at which they are disposed. The total rotational inertia of a ski with the additional weights can then be determined by adding the rotational inertia of the ski to the rotational inertia of the individual weights.

The following chart illustrates a comparison of rotational characteristics of a 1200 gram carbon ski without weighting, a 1200 gram carbon ski with 75 gram weights disposed in proximity to the contact points, and a conventional wood/fiberglass 2200 gram ski. It has been determined that 75 gram weights are an optimum weight for increasing the performance of a lightweight ski for an average skier. The measurement of stability control is used to determine the overall stability of a ski accounting for both rotational inertia and torsion.

Stability Control = (Rotational Inertia × Torsional Stiffness)/Weight

| Ski Performance Comparison | Rotational Inertia (RI) | Total Ski Weight (grams) | Torsional Stiffness | Stability Control |
|---|---|---|---|---|
| Carbon ski | 100 | 1200 | 6.7 | 54.4 |
| Carbon ski with ski stability system | 125 | 1350 | 6.7 | 60.8 |
| Wood/Fiberglass ski | 142 | 2200 | 3.3 | 21.2 |

The chart above illustrates how the addition of two 75 gram weights to the carbon ski increased the rotational inertia by 25% while only constituting a weight increase of less than 10%. The additional weights had no affect on the torsional stiffness of the carbon ski. However, the carbon ski has an inherently high torsional stiffness due to the material properties of carbon fiber. Therefore, the overall stability control measurement of the carbon ski is approximately 3× higher than the conventional ski.

Figure 2:
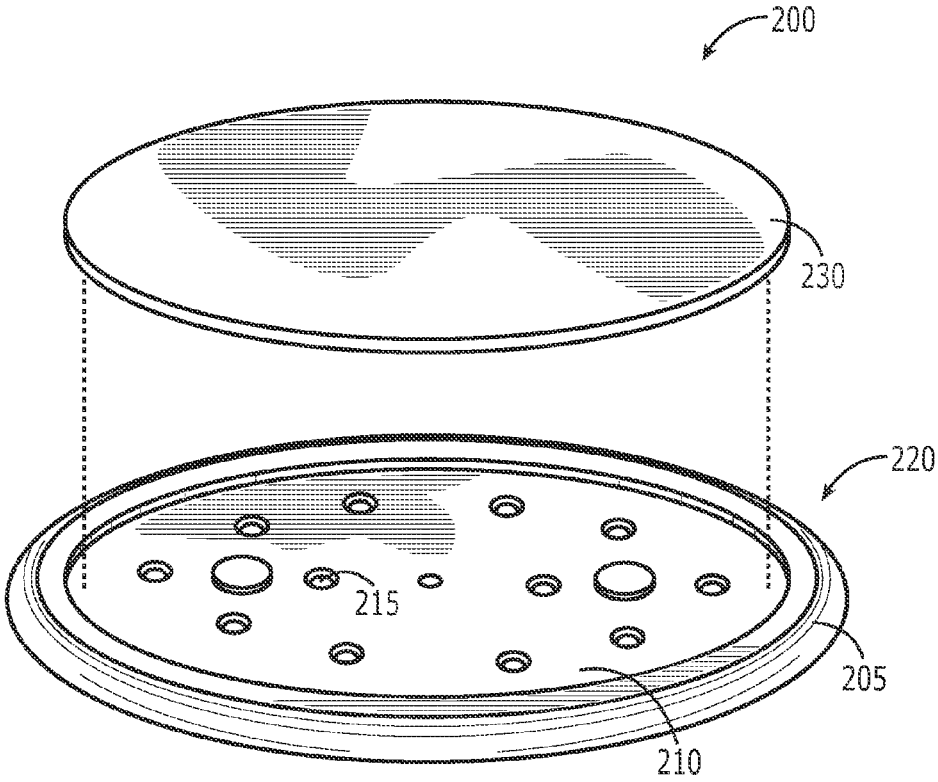
FIG. 2 illustrates one embodiment of a weighted member of the ski stability system illustrated in FIG. 1.

Reference is next made to FIG. 2, which illustrates one embodiment of a weighted member component of the ski stability system illustrated in FIG. 1, designated generally at 200. It will be appreciated that numerous different shapes, materials, and systems may be used for the weighted member in accordance with the present invention. The weighted member 200 includes a housing 220 and a weight element 230. The housing 220 is an oval shaped receptacle that includes an outer rib 205, an inner region 210, and a plurality of connection holes 215. The housing 220 is composed of a flexible plastic material. The oval shape of the housing 220 is designed to maximize adhesion with the ski during flexion and vibration. The outer rib 205 forms a raised surface to facilitate the inclusion of materials within the inner region 210 while maintaining a flush or recessed profile. The connection holes 215 may facilitate an increase in adhesion between the housing 220 and a ski by allowing a chemical bonding agent to extend upward into the connection holes 215. An acrylic bonding agent may be used to adhere the housing 220 to a ski and/or the weight element 230 to the housing 220. Suitable chemical bonding agents include but are not limited to 3M product numbers 5952VHB and 9485PC.

The weighed member 230 is composed of a dense material with sufficient flexibility/malleability to conform to the flex of the ski and housing 220 so as to maintain adhesion. One suitable material for the weighted member 230 is lead. As illustrated, the weighted member 230 is shaped to fit within the inner region 210 of the housing 220 without exceeding the vertical dimension of the outer rib 205.

Figure 3:
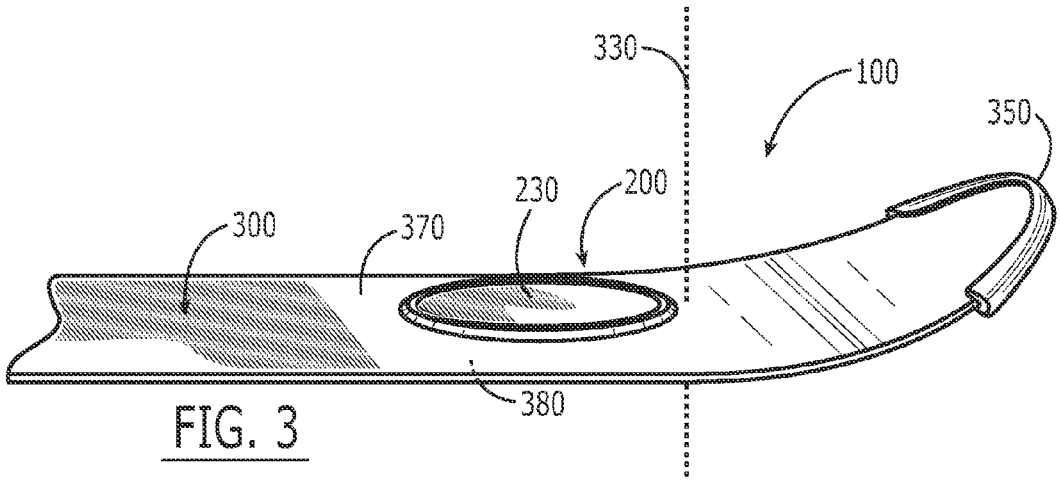
FIG. 3 illustrates a detailed perspective view of the frontal or forward region of a ski in accordance with embodiments of the present invention.

Reference is next made to FIG. 3, which illustrates a detailed perspective view of the frontal or forward region of a ski showing the stability system in accordance with embodiments of the present invention. The system 100 includes the ski 300 and the weighted member 200. The ski 300 includes an upper surface 370, a lower surface 380, a tip 350, and a tip contact point 330. The weighted member 200 is positioned such that the lengthwise or longest dimension is parallel to the longest dimension of the ski. This orientation minimizes the chances for cross-ski collision and/or surface debris disturbance of the weighted member 200. The weighted member 200 is also shown set back from the exact tip contact point a particular amount so as to be within a vicinity of the tip contact point. The illustrated weighted member 200 is within 10 centimeters of the tip contact point. The positioning of the weighted member 200 in front of the contact point has been determined to result in undesirable vibrations.

Figure 4:
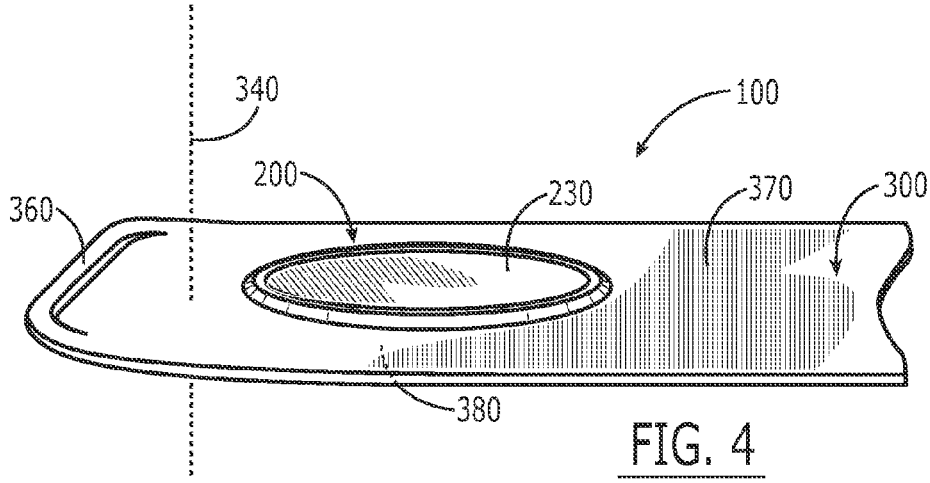
FIG. 4 illustrates a detailed perspective view of a rear or aft region of a ski in accordance with embodiments of the present invention.

Reference is next made to FIG. 4, which illustrates a detailed perspective view of a rear or aft region of a ski showing the stability system in accordance with embodiments of the present invention. The system 100 includes the ski 300 and the weighted member 200. The ski 300 includes an upper surface 370, a lower surface 380, a tip 360, and a tip contact point 340. The weighted member 200 is positioned such that the lengthwise or longest dimension is parallel to the longest dimension of the ski. It will be appreciated that different ski have different tip and tail contact points and therefore the exact positioning of the weighted member 200 should be optimized for the particular ski.

What is claimed is:

1. A ski stability system comprising:

a ski including an upper surface, a lower surface, a tip, a tail, and a medial point disposed equidistantly between the tip and tail, wherein the tip includes a laterally curved upward region on the lower surface, and wherein the tip further includes a contact point corresponding to the furthest distance from the medial point before the laterally curved upward region;

a weighted member lengthwise disposed within 10 centimeters of the contact point of the tip toward the medial point on the upper surface of the ski, wherein the weighted member weights at least 3% of the ski weight.

2. The ski stability system of claim 1, wherein the tail includes a laterally curved upward region, and wherein the tail further includes a contact point corresponding to the furthest distance from the medial point before the upward curvature on the lower surface, and wherein system further includes a second weighted member lengthwise disposed within a region contained within 10 centimeters of the contact point of the tail on the upper surface of the ski, wherein the weighted member weights at least 3% of the overall ski weight.

3. The ski stability system of claim 1, wherein the weighted member increases the rotational inertia of the ski by at least 5%.

4. The ski stability system of claim 1, wherein the weighted member is chemically bonded to the upper surface of the ski.

5. The ski stability system of claim 1, wherein the weighted member is oval shaped and disposed on the ski with the longest dimension oriented substantially parallel to the longest dimension of the ski.

6. The ski stability system of claim 1, wherein the weight of the weighted member is between 3% and 10% of the ski weight.

7. The ski stability system of claim 1, wherein the weight of the weighted member is 75 grams.

8. The ski stability system of claim 1, wherein the overall ski weight is less than 2000 grams.

9. A ski stability system comprising:

a ski including an upper surface, a lower surface, a tip, a tail, wherein the overall ski weight is less than 2000 grams;

at least one weighted member lengthwise disposed within 20 centimeters toward the medial point of at least one of the tip and tail on the upper surface of the ski, wherein each of the at least one weighted members weights at least 3% of the ski weight.

10. The ski stability system of claim 9, wherein the at least one weighted member includes a weighted member disposed within 20 centimeters of both the tip and tail on the upper surface of the ski.

11. The ski stability system of claim 9, wherein the at least one weighted member increases the rotational inertia of the ski by at least 5%.

12. The ski stability system of claim 9, wherein the at least one weighted member is chemically bonded to the upper surface of the ski.

13. The ski stability system of claim 9, wherein the at least one weighted member is oval shaped and disposed on the ski with the longest dimension oriented substantially parallel to the longest dimension of the ski.

14. The ski stability system of claim 9, wherein the weight of each of the at least one weighted members is between 3% and 10% of the ski weight.

15. The ski stability system of claim 9, wherein the weight of each of the at least one weighted members is 75 grams.

16. A method for increasing the rotational inertia of a lightweight ski comprising the acts of:

providing a ski weighting less than 2000 grams, wherein the ski includes a tip and tail;

identifying a tip contact point corresponding to a lengthwise location on the ski at which the lower surface curves laterally upward in proximity to the tip; and disposing a first weighted member on an upper surface of the ski within 10 centimeters toward the medial point of the tip contact point, wherein the first weighted member weight at least 3% of the ski weight.

17. The method of claim 16, further including the acts of identifying a tail contact point corresponding to a lengthwise location on the ski at which the lower surface curves laterally upward in proximity to the tail; and disposing a second weighted member on an upper surface of the ski within 10 centimeters toward the medial point of the tail contact point, wherein the first weighted member weight at least 3% of the ski weight.

18. The method of claim 16, wherein the act of disposing a first weighted member on an upper surface of the ski within 10 centimeters toward the medial point of the tip contact point further includes a first weighted member weighting substantially 75 grams.

19. The method of claim 16 further including the act of increasing the rotational inertia of the ski by at least 5%.

20. The method of claim 16, wherein the act of disposing a second weighted member on an upper surface of the ski within 10 centimeters toward the medial point of the tail contact point further includes a first oval shaped weighted member comprising oriented on the ski such that the longest dimension of the first weighted member is substantially parallel to the longest dimension of the ski.

* * * * *